US005206661A

United States Patent [19]

Terajima et al.

[11] Patent Number: 5,206,661

[45] Date of Patent: Apr. 27, 1993

[54] THERMAL TRANSFER RECORDING APPARATUS AND METHOD THAT STABLY CONVEYS

[75] Inventors: Hisao Terajima, Yokohama; Satoshi Wada, Kawasaki; Makoto Kobayashi, Tama; Takehiro Yoshida, Tokyo; Takeshi Ono, Yokohama; Minoru Yokoyama, Yokohama; Takashi Awai, Yokohama; Yasushi Ishida, Tokyo; Akihiro Tomoda, Yokohama, all of Japan

[73] Assignee: Canon Kabushiki Kaisha, Tokyo, Japan

[21] Appl. No.: 429,809

[22] Filed: Oct. 31, 1989

[51] Int. Cl.[5] ..... B41J 2/325

[52] U.S. Cl. ..... 346/76 PH

[58] Field of Search ..... 346/76 PH, 136, 134; 400/578, 611, 612

[56] References Cited

U.S. PATENT DOCUMENTS

| | | | |
|---|---|---|---|
| 4,496,891 | 1/1985 | Kobayashi et al. | 318/696 |
| 4,566,813 | 1/1986 | Kobayashi et al. | 346/76 PH |
| 4,675,698 | 6/1987 | Tsutsumi | 346/76 PH |
| 4,814,789 | 3/1989 | Ono | 346/76 PH |
| 4,896,167 | 1/1990 | Hayakawa | 346/76 PH |

FOREIGN PATENT DOCUMENTS

| | | |
|---|---|---|
| 219119 | 4/1987 | European Pat. Off. . |
| 57-83471 | 5/1982 | Japan . |
| 6258917 | 1/1983 | Japan . |
| 58-201686 | 11/1983 | Japan . |
| 62-199472 | 9/1987 | Japan . |

*Primary Examiner*—Benjamin R. Fuller
*Assistant Examiner*—N Le
*Attorney, Agent, or Firm*—Fitzpatrick, Cella, Harper & Scinto

[57] ABSTRACT

A thermal transfer recording apparatus for transferring the ink of an ink sheet to a recording medium to thereby effect recording of images on the recording medium, the apparatus has ink sheet conveying means for conveying the ink sheet, recording medium conveying means for conveying the recording medium, recording means for acting on the ink sheet to thereby effect recording of images on the recording medium, and control means for controlling the driving torque of the recording medium conveying means in conformity with a quantity of dot driving information.

30 Claims, 10 Drawing Sheets

| FIG. 6A |
| --- |
| FIG. 6B |

THERMAL TRANSFER RECORDING APPARATUS AND METHOD THAT STABLY CONVEYS

BACKGROUND OF THE INVENTION

1. Field of the Invention

This invention relates to a heat transfer recording apparatus and a facsimile apparatus for transferring the ink of an ink sheet to a recording medium to thereby effect recording of images on the recording medium.

Here, the term "heat transfer recording apparatus" covers, in addition to a facsimile apparatus, apparatuses having a recording function such as an electronic typewriter, a copying apparatus and a printer apparatus.

2. Related Background Art

Generally, a thermal transfer printer uses an ink sheet having heat-meltable (or heat-sublimatable) ink applied to a base film, and selectively heats the ink sheet in correspondance with an image signal by a thermal head, and transfers the melted (or sublimated) ink to recording paper to thereby accomplish image recording. Generally, this ink sheet is such that the ink is completely transferred to the recording paper after a signal image recording operation (a so-called one-time sheet) and therefore, it has been necessary that after the termination of the recording of one character or one line, the ink sheet be conveyed by an amount corresponding to the length of the recording and then the unused portion of the ink sheet be reliably brought to the recording position. This has led to the tendency that the amount of ink sheets used increases and the running cost of the heat transfer printer becomes high as compared with an ordinary thermosensitive printer in which recording is effected on thermosensitive paper.

In order to solve such a problem, as disclosed in Japanese Laid-Open Patent Application No. 57-83471, Japanese Laid-Open Patent Application No. 58-201686 and Japanese Patent Publication (examined) No. 62-58917, there have been proposed thermal transfer printers in which the recording paper and ink sheet are conveyed with a velocity difference provided therebetween. As described in the aforementioned publications, there is known an ink sheet capable of plural (n) times of image recording (a so-called multiprint sheet), and if such an ink sheet is used, when a record length L is to be continuously recorded, recording can be accomplished with the conveyed length of the ink sheet conveyed after or during each image recording being made less than the length L ($L/n:n>1$). Thereby, the efficiency of use of the ink sheet is increased to n times, and a reduction in the running cost of the heat transfer printer can be expected. This recording system will hereinafter be referred to as multiprint.

In the case of the multiprint using such an ink sheet, the ink of the ink layer of the ink sheet is heated divisionally n times, and during each such heating, a shearing force is produced between the ink of the ink layer which is melted or sublimated and the ink which is not melted or sublimated to thereby accomplish the transfer of the ink to recording paper. During this transfer recording, a velocity difference is provided between the conveyance velocity of the recording paper and the conveyance velocity of the ink sheet and therefore, a great load is exerted on a recording paper conveying motor when, for example, after the recording of one line, the recording paper is conveyed for the recording of the next line. This may lead to the undesirable possibility that under the great influence of the quantity of black information (the number of heat generating dots) in the recording data of one line, the conveyance of the recording paper becomes irregular corresponding to the recording data and the recording interval becomes non-uniform. Therefore, it is conceivable to employ a recording paper conveying motor of greater torque, but this leads to the problem of increased cost of the apparatus. Also, if the torque of the motor is increased, overshoot, residual vibration or the like may be produced during the recording of a line imposing a small load and thereby cause noise or adversely affect the conveyance of the recording paper.

SUMMARY OF THE INVENTION

It is an object of the present invention to provide a thermal transfer recording apparatus and a facsimile apparatus which can obtain clear-cut recorded images.

It is another object of the present invention to provide a thermal transfer recording apparatus and a facsimile apparatus in which a recording medium can be conveyed.

It is still another object of the present invention to provide a thermal transfer recording apparatus and a facsimile apparatus in which a uniform recording interval can be obtained.

It is yet still another object of the present invention to provide a thermal transfer recording apparatus and a facsimile apparatus in which noise attributable to overshoot, residual vibration or the like can be reduced or prevented.

It is a further object of the present invention to provide a thermal transfer recording apparatus and a facsimile apparatus in which the quantity of the black information of the recording data of image information to be recorded (the number of data for driving dots for heat generation) is determined and in conformity with the value thereof, the torque of conveying means for conveying a recording medium is changed to thereby stabilize the conveyance of the recording medium.

DESCRIPTION OF THE PREFERRED EMBODIMENTS

An embodiment which will hereinafter be described in which when the recording of images is effected on a recording medium, the quantity of the black information of image data recorded (the number of data for driving dots for heat generation) is counted and the driving torque of a recording medium conveying means for conveying the recording medium is changed correspondingly to the counted quantity of the black information.

A preferred embodiment of the present invention will hereinafter be described in detail with reference to the accompanying drawings.

DESCRIPTION OF FACSIMILE APPARATUS (FIGS. 1-4)

Figure 1A:
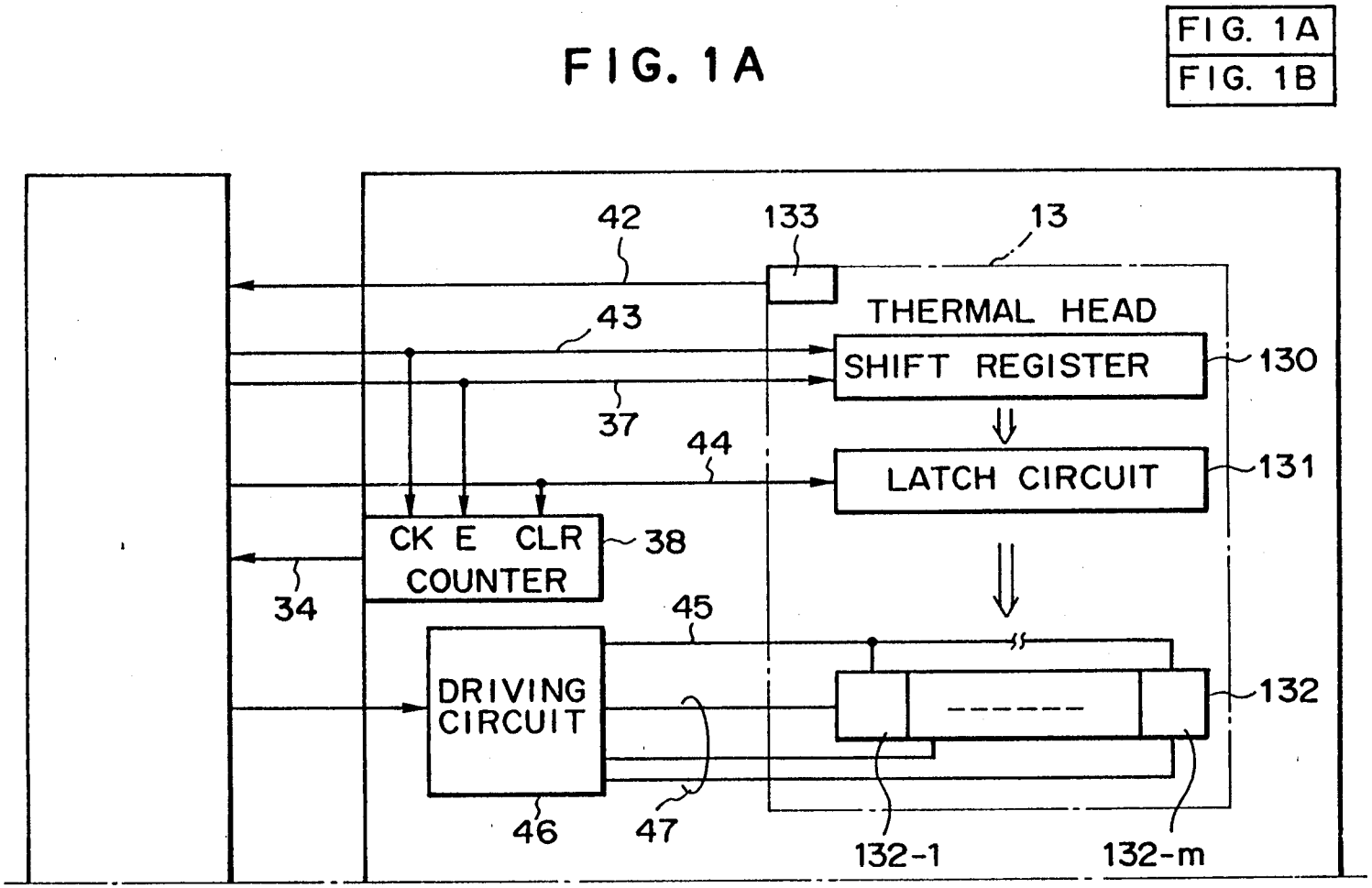
FIGS. 1A, 1B show the electrical connections between a control unit and a recording unit in an embodiment of the present invention.
Figure 1B:
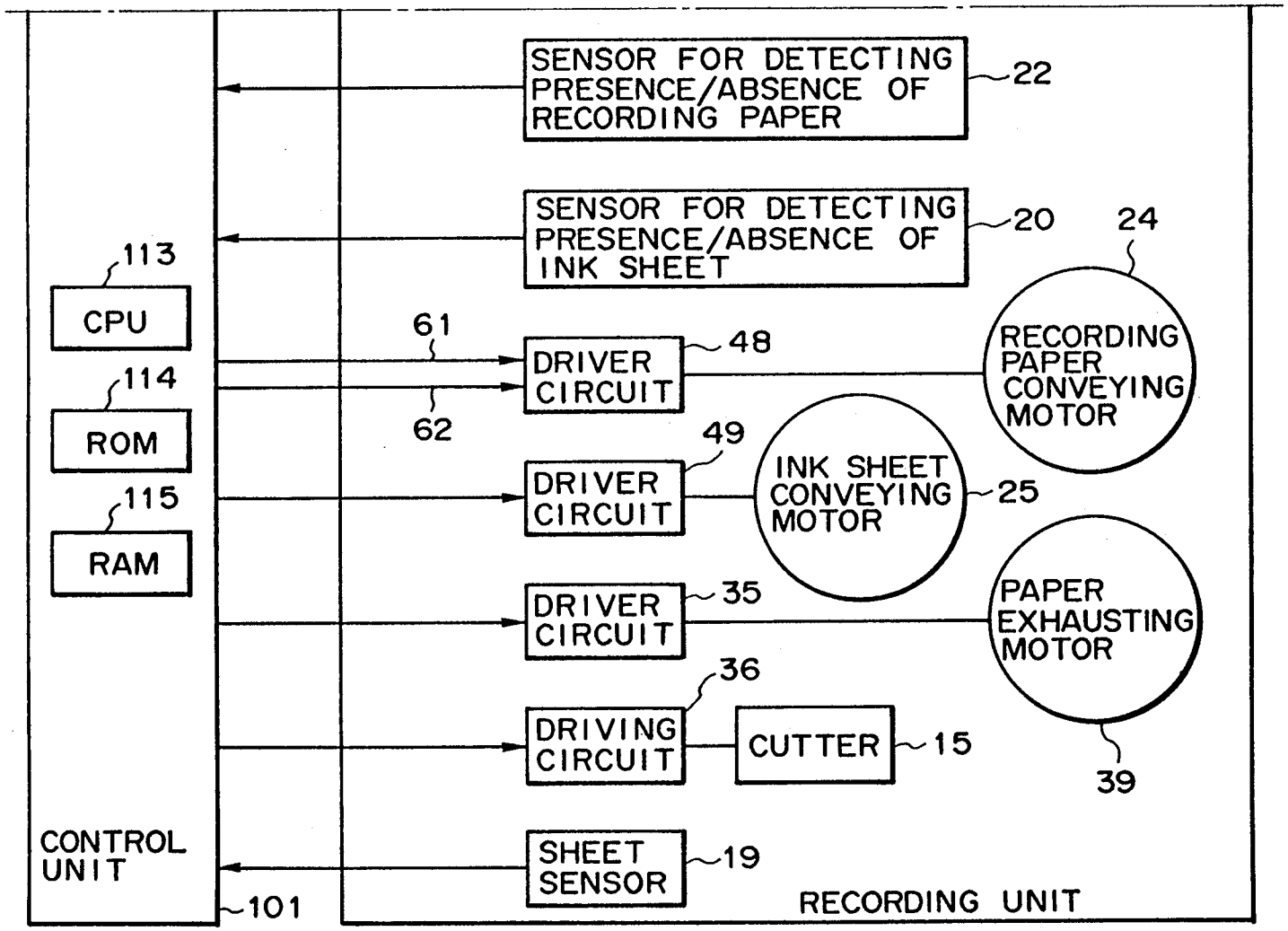
Figure 2:
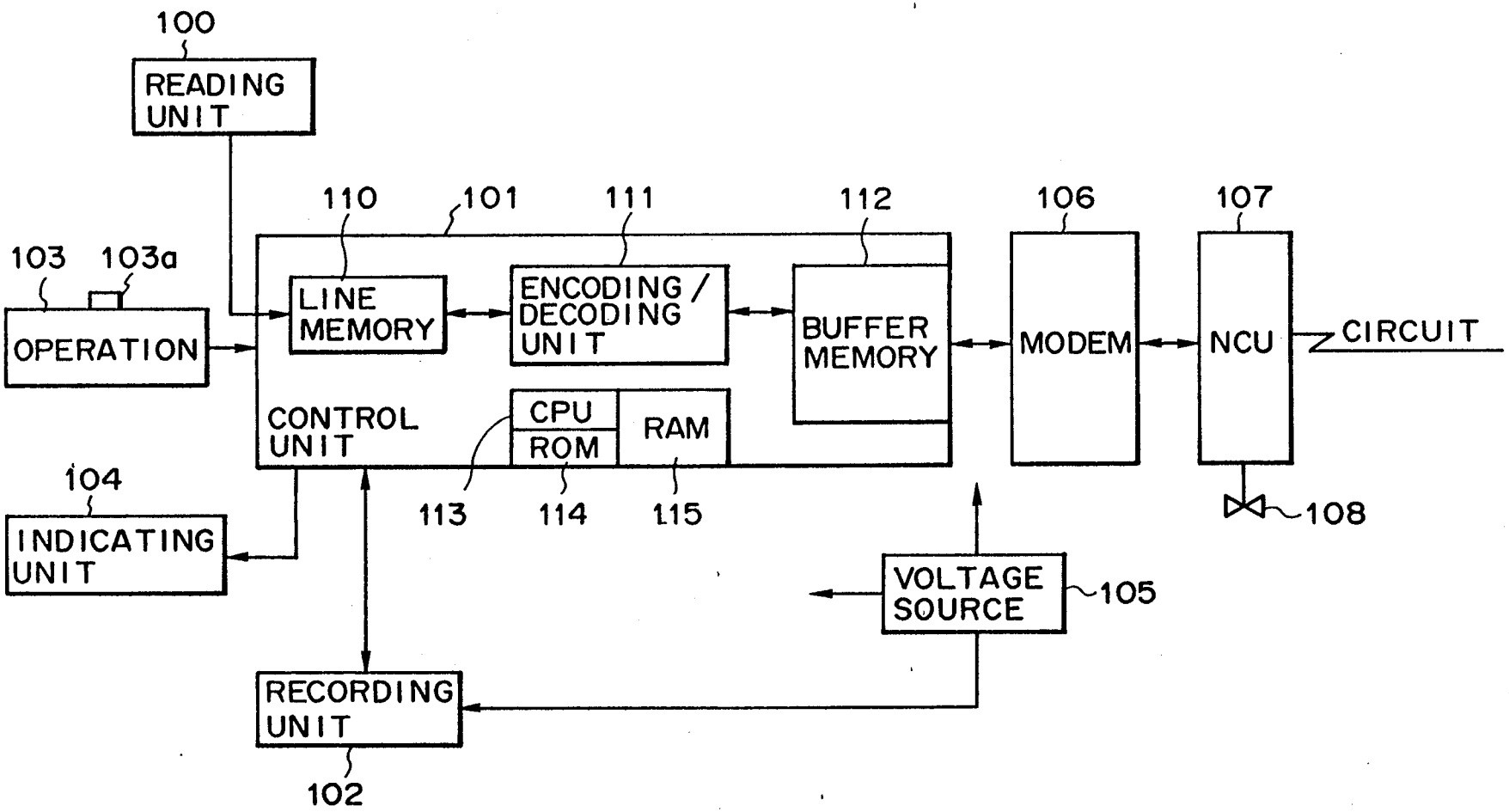
FIG. 2 is a block diagram schematically showing the construction of a facsimile apparatus according to an embodiment of the present invention.
Figure 3A:
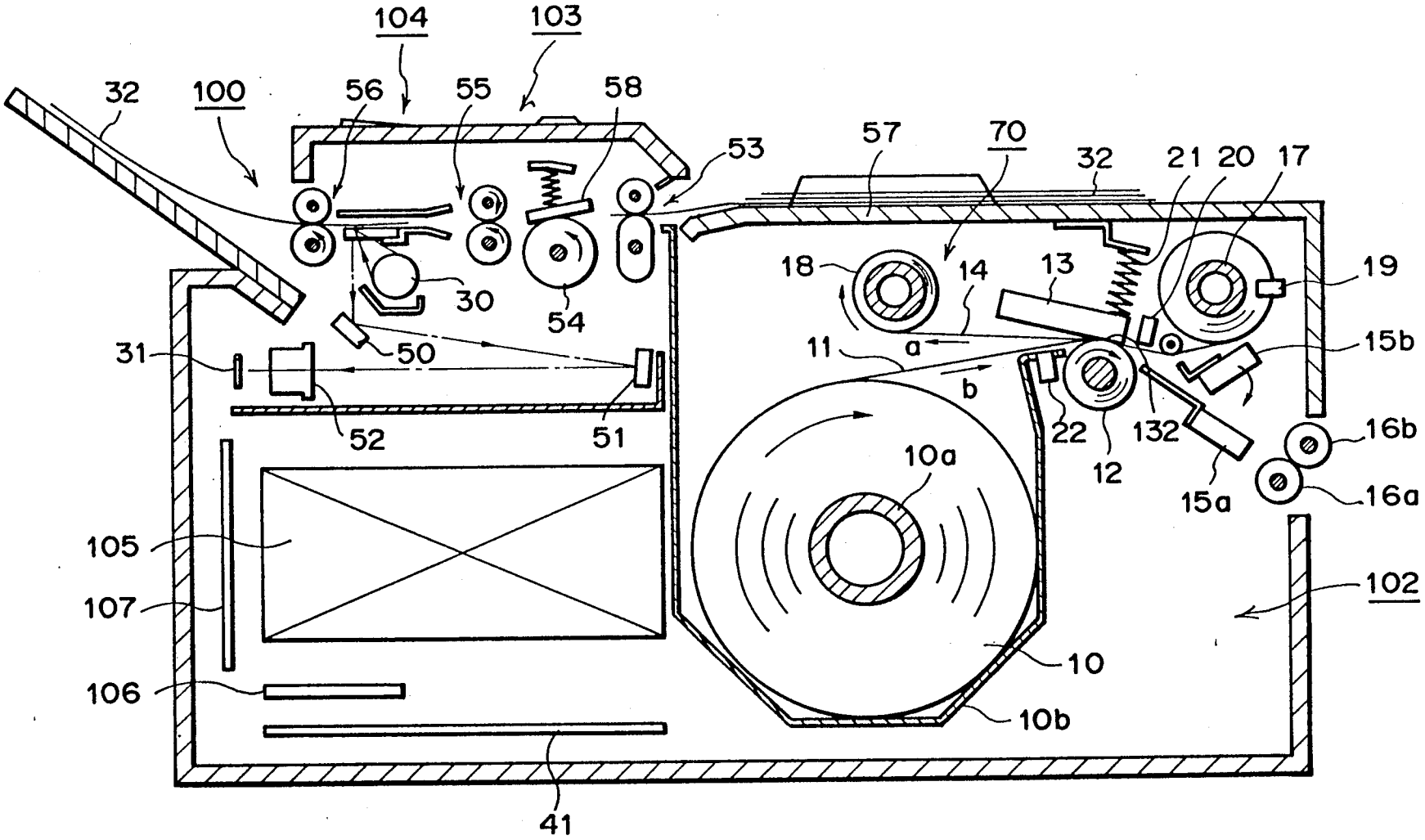
FIG. 3A is a side cross-sectional view showing the mechanism portion of the facsimile apparatus of FIG. 2.
Figure 3B:
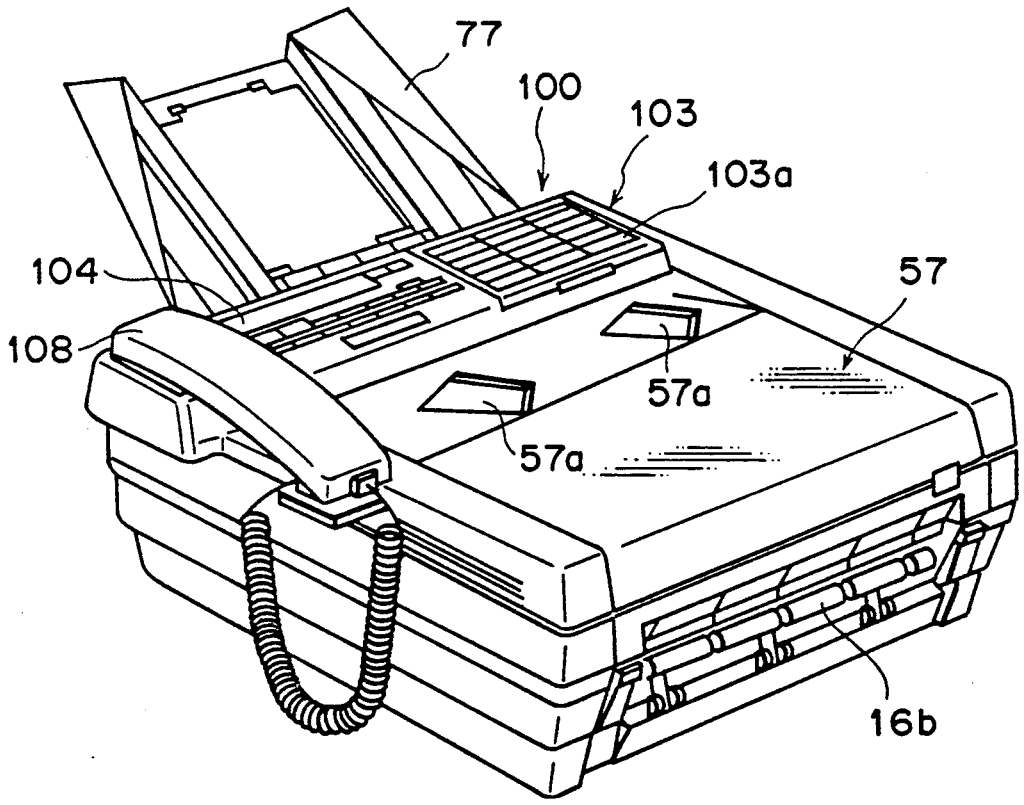
FIG. 3B is a pictorial perspective view of the same facsimile apparatus.
Figure 4:
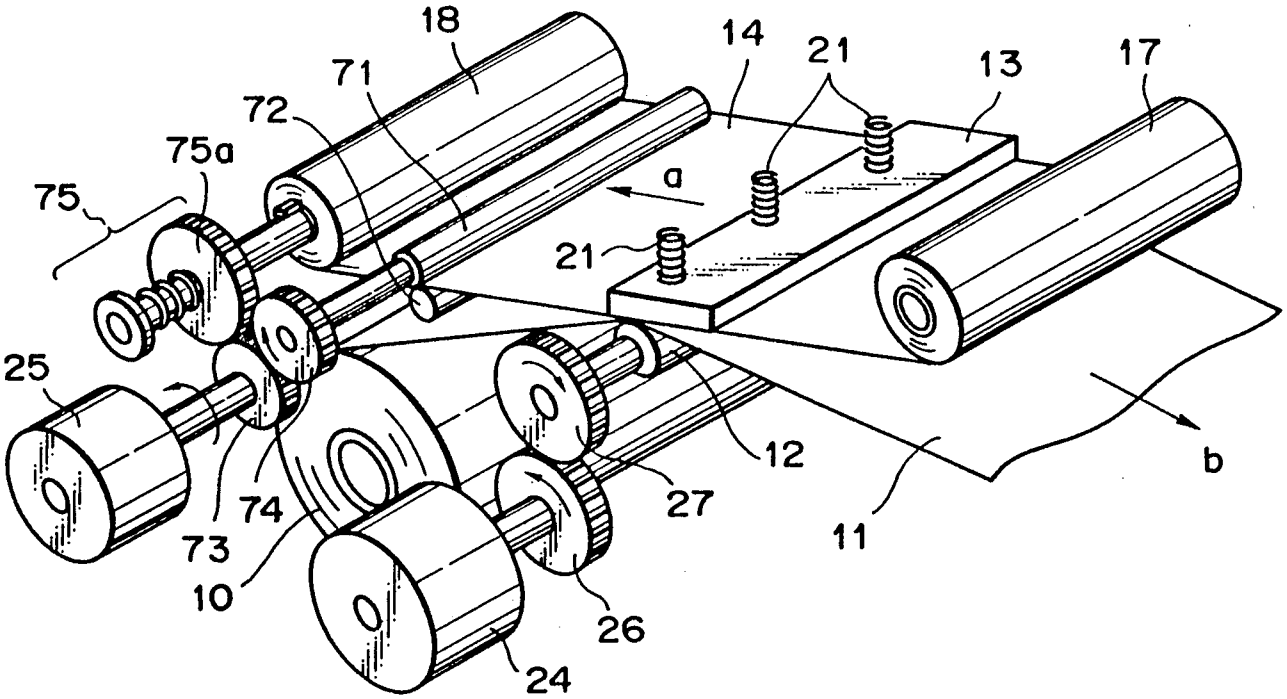
FIG. 4 shows the structure of a conveying system for an ink sheet and recording paper.

FIGS. 1-4 show an example in which a thermal transfer printer using an embodiment of the present invention is employed in a facsimile apparatus. FIG. 1 shows the electrical connections between the control unit 101 and the recording unit 102 of the facsimile apparatus, FIG. 2 is a block diagram schematically showing the construction of the facsimile apparatus, FIG. 3A is a side cross-sectional view of the facsimile apparatus, FIG. 3B is a pictorial perspective view of the facsimile apparatus, and FIG. 4 shows a conveying mechanism for recording paper and an ink sheet.

The construction of the facsimile apparatus will first be schematically described with reference to FIG. 2.

In FIG. 2, reference numeral 100 designates a reading unit for photoelectrically reading an original and outputting it as a digital image signal to the control unit 101. Reading unit 100 is provided with an original conveying motor, a CCD image sensor, etc. The construction of the control unit 101 will now be described. Reference numeral 110 denotes a line memory for storing the image data of each line of image data therein. During the transmission or copying of an original, the image data for one line from the reading unit 100 is stored in the line memory, and during the reception of image data, one line data of decoded received image data is stored in the line memory. By the stored data being output to the recording unit 102, image formation is effected. Reference numeral 111 designates an encoding/decoding unit for encoding transmitted image information by MH encoding or the like and decoding received encoded image data and converting it into image data. Reference numeral 112 denotes a buffer memory for storing the transmitted or received encoded image data therein. These various portions of the control unit 101 are controlled by a CPU 113 such as a microprocessor. Control unit 101 is provided with an ROM 114 storing therein the control program and various data of the CPU 113, and RAM 115 for temporarily preserving therein various data as the work area of the CPU 113, etc. in addition to the CPU 113.

Recording unit 102 is provided with a thermal line head (having a plurality of heat generating elements 132 over the same width as the recording width), and effects image recording on recording paper by the heat transfer recording method. The construction of this recording unit will be described in detail later with reference to FIG. 3. Reference numeral 103 designates an operation unit including keys for indicating various functions such as commencing transmission etc. and telephone number input keys, and the reference character 103*a* denotes a switch for indicating the kind of an ink sheet 14 being used. When the switch 103*a* is ON, it indicates that a multiprint ink sheet is mounted, and when the switch 103*a* is OFF, it indicates that a one-time ink sheet is mounted. Reference numeral 104 designates an indicating unit usually provided adjacent to the operation unit 103 for indicating various functions and the state of the apparatus. Reference numeral 105 denotes a voltage source unit for supplying electric power to the entire apparatus. Reference numeral 106 designates a modem (modulator-demodulator), the reference numeral 107 denotes a net control unit (NCU), and the reference numeral 108 designates a telephone set.

The construction of the recording unit 102 will now be described in detail with reference to FIG. 3. In FIG. 3, portions corresponding to those in FIG. 2 are given identical reference numerals.

In FIG. 3, the reference numeral 10 designates a roll of paper comprising recording paper 11 which is plain paper wound into the form of a roll on a core 10*a*. This roll of paper 10 is rotatably contained in the apparatus so that the recording paper 11 can be supplied to a thermal head unit 13 by the rotation of a platen roller 12 in the direction of the arrow. The reference character 10*b* denotes a roll of paper loading portion in which the roll of paper 10 is removably loaded. The platen roller 12 conveys the recording paper 11 in the direction of arrow b and also presses the ink sheet 14 and the recording paper 11 between it and the heat generating members 132 of the thermal head 13. The recording paper 11 on which image recording has been effected by the heat generation of the thermal head 13 is conveyed toward discharge rollers 16 (16*a*, 16*b*) by further rotation of the platen roller 12, and when image recording of one page is terminated, the recording paper 11 is cut into a page length by meshing engagement between cutters 15 (15*a*, 15*b*) and is discharged.

Reference numeral 17 designates an ink sheet supply roll on which the ink sheet 14 is wound, and the reference numeral 18 denotes an ink sheet take-up roll which is driven by an ink sheet conveying motor to be described to thereby take up the ink sheet 14 in the direction of arrow a. The ink sheet supply roll 17 and the ink sheet take-up roll 18 are removably loaded in an ink sheet loading portion 70 within the apparatus body. Reference numeral 19 designates a sensor for detecting the remaining amount of the ink sheet 14 and detecting the conveyance velocity of the ink sheet 14. Reference numeral 20 denotes an ink sheet sensor for detecting the presence or absence of the ink sheet 14, and the reference numeral 21 designates a spring for pressing the thermal head 13 against the platen roller 12 with the recording paper 11 and the ink sheet 14 interposed therebetween. Reference numeral 22 denotes a recording paper sensor for detecting the presence or absence of the recording paper.

The construction of the reading unit 100 will now be described.

In FIG. 3, the reference numeral 30 designates a light source for irradiating an original 32. The light reflected by the original 32 is input to a CCD sensor 31 through an optical system (mirrors 50, 51 and a lens 52), and is converted into an electrical signal. The original 32 is conveyed correspondingly to the reading speed of the original 32 by conveying rollers 53, 54, 55 and 56 which are driven by an original conveying motor, not shown. Reference numeral 57 denotes an original supporting table. A plurality of originals 32 supported on this supporting table 57 are individually separated by the cooperation between the conveying roller 54 and a press-separating piece 58 which being guided by a slider 57*a*, and they are conveyed to the reading unit 100, where they are read, and then are discharged onto a tray 77.

Reference numeral 41 designates a control base plate constituting the essential portion of the control unit 101. Various control signals are output from this control base plate 41 to various portions of the apparatus. Reference numeral 105 denotes a voltage source unit, the reference numeral 106 designates a modem base plate unit, and the reference numeral 107 denotes an NCU base plate unit.

FIG. 4 shows the details of a conveying mechanism for the ink sheet 14 and the recording paper 11.

In FIG. 4, the reference numeral 24 designates a recording paper conveying motor for driving the platen roller 12 to thereby convey the recording paper 11 in the direction of arrow b opposite to the direction of arrow a. The reference numeral 25 denotes an ink sheet conveying motor for conveying the ink sheet 14 in the direction of arrow a by a capstan roller 71 and a pinch roller 72. The reference numerals 26 and 27 designate transmission gears for transmitting the rotation of the recording paper conveying motor 24 to the platen roller 12, and the reference numerals 73 and 74 denote transmission gears for transmitting the rotation of the ink sheet conveying motor 25 to the capstan roller 71. Reference numeral 75 designates a slide clutch unit.

By setting the ratio of the gears 74 and 75 so that the length of the ink sheet 14 taken up onto the take-up roll 18 by the rotation of a gear 75*a* becomes greater than the length of the ink sheet conveyed by the capstan roller 71, the ink sheet 14 conveyed by the capstan roller 71 is reliably taken up onto the take-up roll 18. An amount corresponding to the difference between the amount of the ink sheet 14 taken up by the take-up roll 18 and the amount of the ink sheet 14 fed by the capstan roller 71 is absorbed by the slide clutch unit 75. This prevents the creation of slack in the ink sheet 14 fluctuations of the conveyance velocity (amount) of the ink sheet 14 caused by the fluctuation in the take-up diameter of the take-up roll 18 can be suppressed.

FIG. 1 shows the electrical connections between the control unit 101 and the recording unit 102 in the facsimile apparatus of the present embodiment, and in FIG. 1, portions common to those in the other figures are designated by identical reference numerals.

The thermal head 13 is a line head. This thermal head 13 is provided with a shift register 130 for receiving as inputs serial recording data 37 for one line and a shift clock 43 from the control unit 101 and storing them therein, a latch circuit 131 for latching the data of the shift register 130 by a latch signal 44, and a heat generating element 132 comprising a heat generating resistance member for one line. The heat generating resistance member 132 is divided into m blocks designated by 132-1 to **132-*m* and driven. The reference numeral 38 designates a counter for counting the number of black data (the number of data causing the heat generating element to generate heat) in the recording data for one line. In this counter 38, the recording data is input to an enable terminal E, the latch signal 44 is input to a clear terminal CLR, and a serial clock 43 synchronized with the recording data is input to a clock terminal CK. When the recording data 37 is "1", the counter counts the rising of the clock signal 43, and outputs the result of the count as a count value 34 to the control unit 101**.

Figure 5:
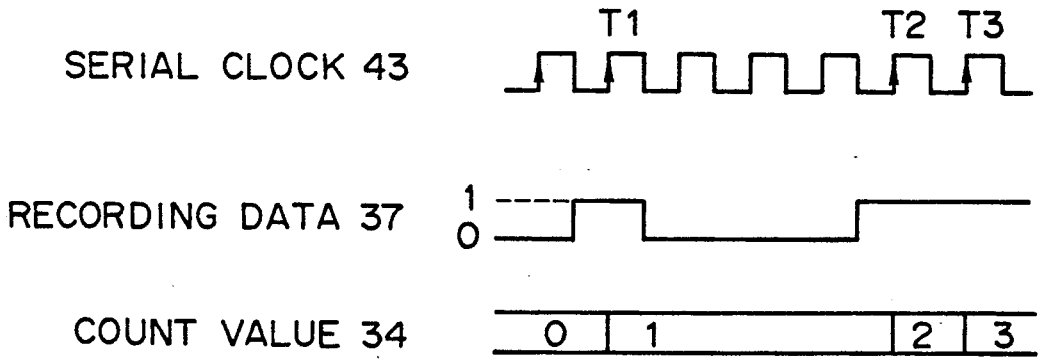
FIG. 5 is a timing chart showing an example of the count timing of a counter.

An example of this timing is shown in FIG. 5. Here, the counter 38 is counted up at the rising (timings T1–T3) of the clock 43 when the recording data 37 is "1" (black data or heat generation data). Accordingly, by this count value 34 being input, the control unit 101 can detect the number of the black dots in one line.

Reference numeral 133 denotes a temperature sensor mounted on the thermal head 13 for detecting the temperature of the thermal head 13. The output signal 42 of this temperature sensor 133 is A/D-converted in the control unit 101 and input to the CPU 113. Thereby the CPU 113 detects the temperature of the thermal head 13, and changes the pulse width of a strobe signal 47 correspondingly to the detected temperature or changes the driving voltage of the thermal head 13 output to a voltage source line 45, thereby effecting the control of the applied energy to the thermal head 13 conforming to the characteristic of the ink sheet 14.

Design may be made such that the kind (characteristic) of the ink sheet 14 is automatically discriminated by manually operating the switch 103*a* of the aforedescribed operation unit 103 or by detecting a mark printed on the ink sheet 14, or is automatically discriminated by detecting a mark, a cut-away or a projection formed in the cartridge of the ink sheet.

Reference numeral 46 designates a driving circuit for receiving as an input the driving signal of the thermal head 13 from the control unit 101 and outputting the strobe signal 47 which drives the thermal head 13 at each block unit. Based on instructions from the control unit 101, this driving circuit 46 can change the voltage output to the voltage source line 45 which supplies an electric current to the heat generating element 132 of the thermal head 13 and change the energy applied to the thermal head 13. The reference numeral 36 denotes a driving circuit for bringing the cutters 15 into meshing engagement and driving the same. The driving circuit 36 includes a cutter driving motor, etc. Reference numeral 39 designates a paper discharging motor for rotatably driving the paper discharge rollers 16. The reference numerals 35, 48 and 49 denote driver circuits for driving the corresponding paper discharge motor 39, recording paper conveying motor 24 and ink sheet conveying motor 25, respectively. A signal 61 input to the driver circuit 48 is a control signal for controlling the driving current of the recording paper conveying motor 24, and reference numeral 62 designates an excitation phase signal for changing over the excitation phase of the recording paper conveying motor 24. In this embodiment, the paper discharge motor 39, the recording paper conveying motor 24 and the ink sheet conveying motor 25 are stepping motors, although this is not restrictive and they may be, for example, DC motors or the like.

DESCRIPTION OF THE RECORDING OPERATION (FIGS. 1–6)

Figure 6A:
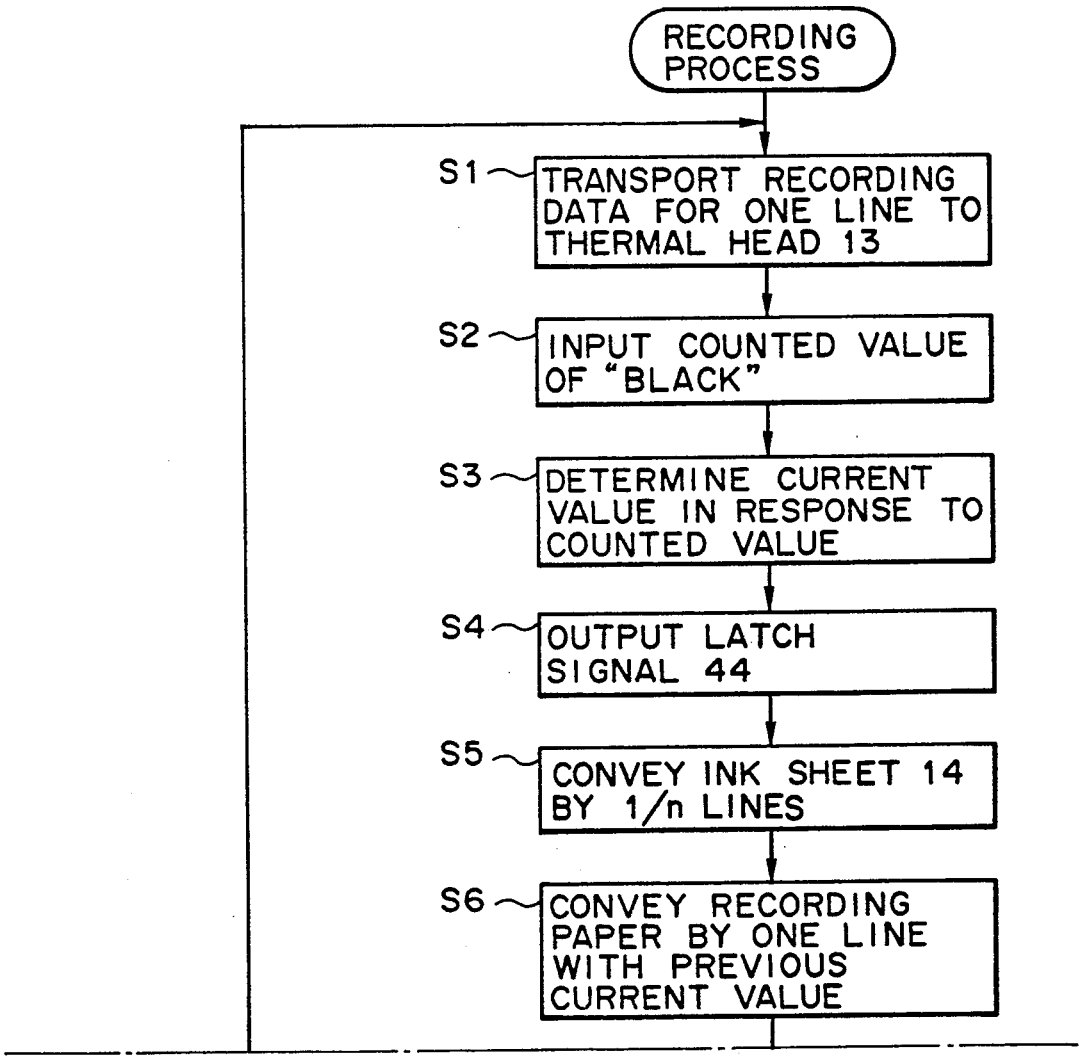
FIGS. 6A, 6B are flow charts showing the recording process of an embodiment.
Figure 6B:
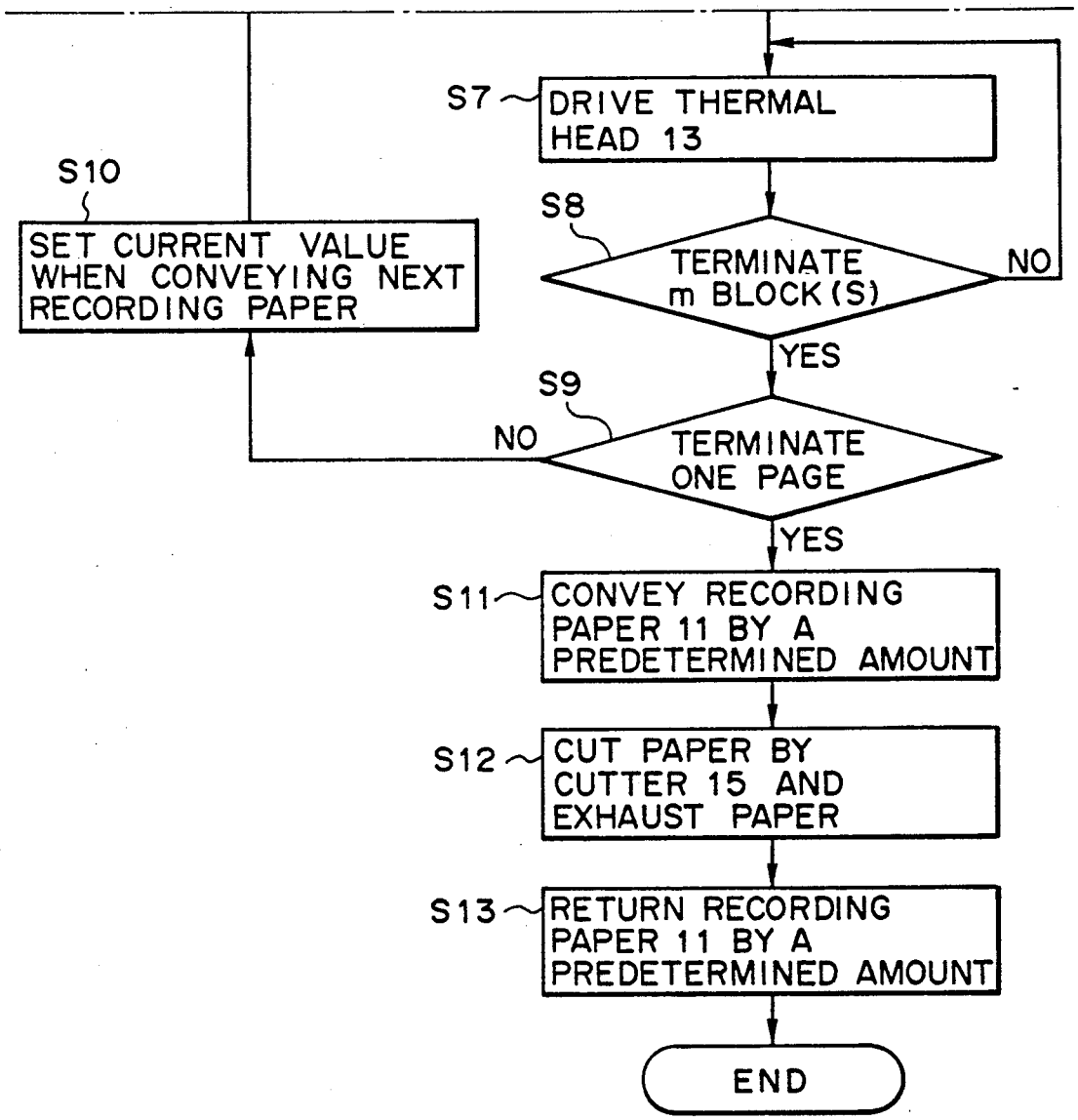

FIG. 6 is a flow chart showing the recording process for one page in the facsimile apparatus of this embodiment, and the control program for executing this process is stored in the ROM 114 of the control unit 101.

This process is started by storing the image data for one line in the line memory 110, whereby a condition in which the recording operation can be started is brought about. It is to be understood that it is judged in the control unit 101 by a switch 103*a* or the like that a multiprint ink sheet 14 is mounted.

First, at step S1, recording data for one line is serially output to the shift register 130. At this time, the counter 38 counts the bit number which is "1" (black) of the serial data for one line. When the transport of the recording data for one line is terminated, at step S2, the counted value 34 from the counter 38 is input. At step S3, the table or the like, not shown, of the ROM 114 is referred to on the basis of this counted value, and the driving current of the recording paper conveying motor 24 to be indicated to the driver circuit 48 is determined by a control signal 41. This current value is set to a greater value as the counted value 34 becomes greater. Also, this current value is set to a smaller value as the counted value 34 becomes smaller. Accordingly, if the counted value 34 becomes greater, the torque of the motor 24 becomes greater, and if the counted value 34 becomes smaller, the torque of the motor 24 becomes smaller. In the present embodiment, the driving current is determined with reference to the table and thus, the driving current varies stepwise, but of course, the driving current may be varied continuously.

Advance is then made to step S4, where the latch signal 44 is output and the recording data for one line is stored into the latch circuit 131. At the same time, the counter 38 is cleared by this latch signal 44. Subsequently, at step S5, the ink sheet conveying motor 25 is driven to convey the ink sheet 14 by an amount corresponding to 1/n lines. Then, at step S6, the recording paper conveying motor 24 is driven to convey the recording paper 11 by an amount corresponding to one line. The driving current value indicated to the driver circuit 48 at this time by the control signal 61 is the driving current determined by the recording data for the previous line. It is to be understood that during the recording of the first line on one page, this current value is set to a suitable value. Also, the length of one line is set to about 1/15.4 mm in the facsimile apparatus, and the amounts of conveyance of the recording paper 11 and the ink sheet 14 can be set by changing the excitation pulse numbers of the recording paper conveying motor 24 and the ink sheet conveying motor 25, respectively.

Subsequently, at step S7, one block of the heat generating resistance member 132 is electrically energized to effect image recording, and at step S8, whether the electrical energization of all blocks of the thermal head 13 has been terminated is examined. If at the step S8, the electrical energization of all blocks of the thermal head 13 is not terminated, return is made to the step S7, and after the electrical energization time (about 600 μs) has elapsed, the electrical energization of the next block is executed. In this embodiment, the thermal head 13 is divided into four blocks and electrically energized, and the time required for the recording of one line is approximately 2.5 ms.

If at step S8, the electrical energization of all blocks of the thermal head 13 is terminated and the recording of one line is terminated, advance is made to step S9, where whether the image recording of one page has been terminated is examined. If the image recording of one page is not terminated, advance is made to step S10, where the driving current value when the recording paper 11 is conveyed next time is set to value determined at the step S3. Thus, return is then made to step S1, where the image data for the next one line to be recorded is transported to the thermal head 13, and the aforedescribed recording process is executed.

When at step S9, the image recording of one page is terminated, advance is made to step S11, where the recording paper 11 is conveyed by a predetermined amount toward the paper exhausting rollers 16*a* and 16*b*. At step S12, the cutters 15*a* and 15*b* are driven into meshing engagement with each other, whereby the recording paper 11 is cut into a page length. Subsequently, at step S13, the recording paper conveying motor 24 is reversely driven to return the recording paper 11 by a distance corresponding to the spacing between the terminal head 13 and the cutters 15, and the cutting process for the recording paper 11 is executed.

Thus, according to the present embodiment, the number of the black data recorded for each line is counted and correspondingly to that number, the driving torque of the recording paper conveying motor 24 is adjusted, whereby any fluctuation of the conveyance load of the recording paper can be coped with.

In this embodiment, during the conveyance process of the recording paper 11 of the step S6, driving current of the recording paper conveying motor 24 is determined on the basis of the last current value, but alternatively, the driving current value found at step S3 may be set as it is.

Also, in this embodiment, the number of the black dots of the image data in one line is counted by the counter 38, whereas this is not restrictive, but said number may be counted by software.

DESCRIPTION OF THE PRINCIPLE OF RECORDING (FIG. 7)

Figure 7:
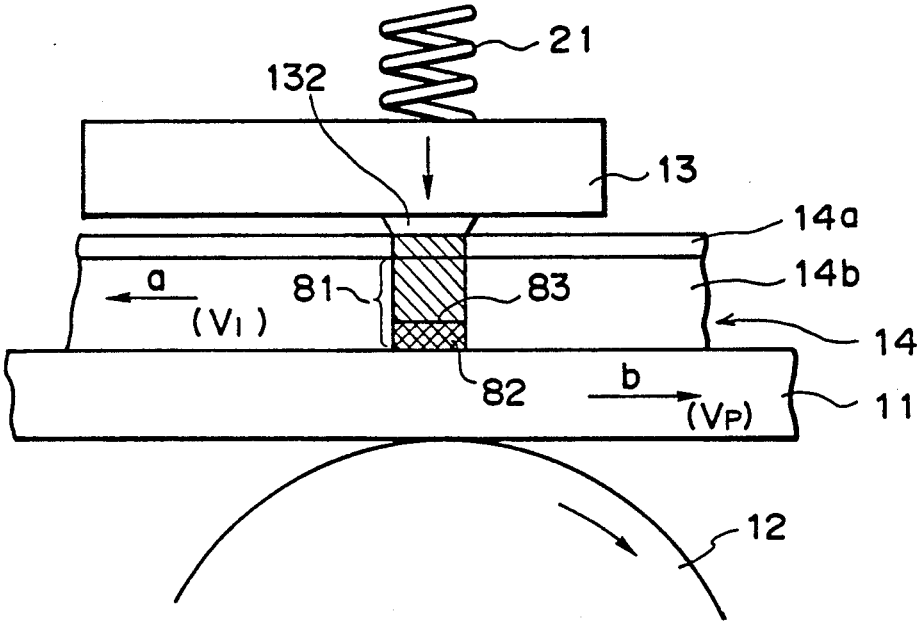
FIG. 7 shows the states of the recording paper and the ink sheet during the recording in this embodiment.

FIG. 7 shows the image recording condition when image recording is effected when the directions of conveyance of the recording paper 11 and the ink sheet 14 are opposite to each other.

As shown, the recording paper 11 and the ink sheet 14 are nipped between the platen roller 12 and the thermal head 13, which is urged against the platen roller 12 with a predetermined pressure by the spring 21. The recording paper 11 is conveyed in the direction of arrow b at a velocity $V_P$ by the rotation of the platen roller 12. On the other hand, the ink sheet 14 is conveyed in the direction of arrow a at a velocity $V_I$ by the rotation of the ink sheet conveying motor 25.

When the heat generating resistance member 132 of the thermal head 13 is electrically energized by the voltage source 105 and thereby heated, that portion of the ink sheet 14 which is indicated by hatching 91 is heated. Here, the reference character 14*a* designates the base film of the ink sheet 14, and the reference character 14*b* denotes the ink layer of the ink sheet 14. The ink of the ink layer 91 heated by the heat generating resistance member 132 being electrically energized is melted, and that portion thereof which is indicated by 92 is transferred to the recording paper 11. This transferred ink layer portion 92 corresponds to approximately 1/n of the ink layer indicated by 91.

During this transfer, it is necessary that the shearing force applied to the ink be produced on the border line of the ink layer 14*b* and only the portion indicated by 92 be transferred to the recording paper 11. However, this shearing force differs depending on the temperature of the ink layer, and tends to become smaller as the temperature of the ink layer becomes higher. So, if the heating time for the ink sheet 14 is shortened, the shearing force in the ink layer becomes greater and therefore, if the relative velocity of the ink sheet 14 and the recording paper 11 is increased, the ink layer to be transferred can be positively peeled from the ink sheet 14.

DESCRIPTION OF THE INK SHEET (FIG. 8)

Figure 8:
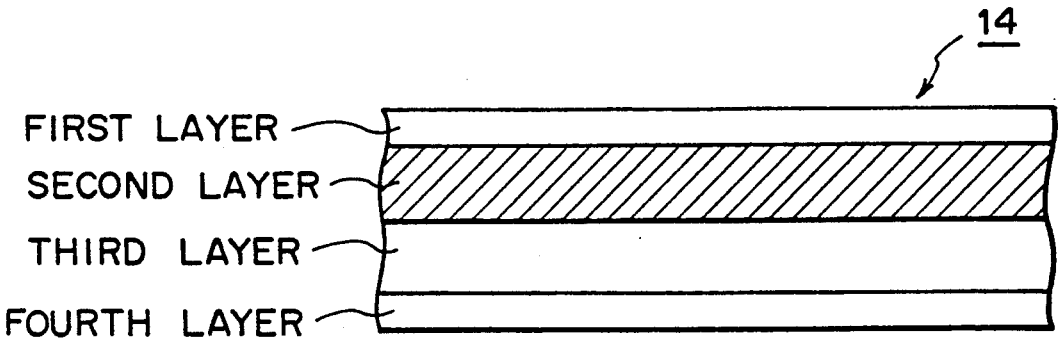
FIG. 8 is a cross-sectional view of a multiprint ink sheet used in this embodiment.

FIG. 8 is a cross-sectional view of the ink sheet used in the multiprint of the present embodiment, and this ink sheet is constructed of four layers.

A second layer is a base film which provides a backup member for the ink sheet 14. In the case of multiprint, heat energy is applied to the same portion many times and therefore, this layer may advantageously be aromatic polyamide film or condenser paper, but conventional polyester film may also stand use. The thickness of this layer may advantageously be as small as possible in respect of the quality of printing from its role as a medium, and may desirably be 3–8 μm from the viewpoint of strength.

A third layer is an ink layer containing therein an amount of ink transferable to the recording paper (recording sheet) n times. The chief components of this layer are resin such as EVA as an adhesive agent, carbon black or a nigrosine dye for coloring, carnauba wax or paraffin wax as a binding material, etc., and these are combined so as to stand n times of use in the same portion. The amount of application of this layer may desirably be 4–8 g/m$^2$, but the sensitivity and concentration differ depending on the amount of application and thus, the amount of application can be arbitrarily selected.

A fourth layer is a top coating layer for preventing the ink of the third layer from being pressure-transferred to the recording paper in the regions thereof which should not be printed, and this layer is formed of transparent wax or the like. Thus, it is only the transparent fourth layer that is pressure-transferred, and the ground of the recording paper can be prevented from being stained. A first layer is a heat resisting coat layer for protecting the base film which is the second layer from the heat of the thermal head 13. This is suitable for multiprint in which heat energy for n lines may be applied to the same portion (when the black information is continuous), but the use or non-use thereof of this layer can be suitably chosen. Also, it is effective for a base film of relatively low heat resisting property such as a polyester film.

The construction of the ink sheet 14 is not limited to this embodiment, but the ink sheet may comprise, for example, a base layer and a porous ink retaining layer provided on one side of the base layer and containing ink therein, or may comprise a base film and a heat resisting ink layer provided on the base layer and having a fine porous net-like structure, the ink layer containing ink therein. The material of the base film may be a film consisting, for example, of polyamide, polyethylene, polyester, polyvinyl chloride, triacetyl cellulose, nylon or the like, or paper. Further, the heat resisting coat layer is not always necessary, but the material thereof may be, for example, silicone resin, epoxy resin, fluorine resin, etholocellulose or the like.

Also, as an example of the ink sheet having heat-sublimating ink, mention may be made of an ink sheet comprising a base material formed of polyethylene terephthalate, polyethylene naphthalate, aromatic polyamide film or the like, and a color material layer provided on the base material and containing spacer particles formed of quanamine resin and fluorine resin, and a dye.

The heating system in the thermal transfer printer is not limited to the aforedescribed thermal head system using a thermal head, but may also be, for example, an electrical energizing system or a laser transfer system.

Also, this embodiment has been described with respect to an example in which a thermal line head is used, whereas the present invention is not restricted thereto, but may be a so-called serial type thermal transfer printer.

Further, the above embodiment has been described with respect to a case where a thermal transfer printer is employed in a facsimile apparatus, whereas this is not restrictive, but the thermal transfer recording apparatus of the present invention is also applicable, in for example, a word processor, a typewriter or a copying apparatus.

The recording medium is not limited to recording paper, but may also be, for example, cloth or a plastic sheet if they permit ink transfer thereto. The ink sheet is not limited to the form of a roll shown in the embodiment, but may also be, for example, of the so-called ink sheet cassette type in which ink sheets are contained within a housing removably mountable on the recording apparatus body and this housing is bodily mounted and dismounted with respect to the recording apparatus body.

In the present embodiment, when the number of the black dots of one line becomes great, the driving current value of the recording paper conveying motor is increased to thereby increase the torque of this motor, whereas this is not restrictive. For example, when the number of the black dots is great, the rotational speed of the recording paper conveying motor may be slowed down and the time interval till the next line may be lengthened to thereby increase the torque of the motor. Also, when the number of the black dots is small, the rotational speed of said motor may be increased and the time interval may be shortened to thereby decrease the torque of the motor.

Also, in the present embodiment, the number of the black dots is counted before the thermal head 13 is driven, whereas this is not restrictive, but the number of the black dots may be counted after the thermal head 13 is driven.

According to the present embodiment, as described above, even if there is a fluctuation of the load during the conveyance of the recording paper, the recording paper can always be conveyed accurately, and this leads to the improved quality of images reproduced.

According to the present invention, as described above, the quantity of the driving information of the recording data of the image information to be recorded is found and in conformity with the value thereof, the torque of the conveying means for conveying the recording medium is changed, whereby the conveyance of the recording medium can be stabilized.

We claim:

1. A thermal transfer recording apparatus for transferring an ink of an ink sheet to a recording medium to thereby effect recording of images on said recording medium, comprising:

ink sheet conveying means for conveying said ink sheet;

recording medium conveying means for conveying said recording medium, said recording medium conveying means having a driving torque;

recording means for acting on said ink sheet to thereby record images on said recording medium when said recording medium and said ink sheet are held together, said driving torque causing said recording medium and said ink sheet to be separated;

counting means for counting a quantity of a dot driving information of image data recorded by said recording means; and control means for controlling said driving torque of said recording medium conveying means in conformity with said quantity of said dot driving information.

2. A thermal transfer recording apparatus according to claim 1, wherein said control means increases a driving current value of said recording medium conveying means to thereby increase the driving torque of said recording medium conveying means when the quantity of dot driving information is great.

3. A thermal transfer recording apparatus according to claim 1, wherein said control means decreases a driving current value of said recording medium conveying means to thereby decrease the driving torque of said recording medium conveying means when the quantity of dot driving information is small.

4. A thermal transfer recording apparatus according to claim 1, wherein said recording means further comprises a thermal head provided with a plurality of heat generating elements, and said dot driving information is information for causing said heat generating elements to generate heat.

5. A thermal transfer recording apparatus according to claim 1, wherein the quantity of said dot driving information is counted before said recording means is driven.

6. A thermal transfer recording apparatus according to claim 1, wherein said ink sheet is a multiprint ink sheet having an amount of the ink enabling plural times of transfer form a same portion.

7. A thermal transfer recording apparatus according to claim 1, wherein the heat transfer recording apparatus is a facsimile apparatus having receiving means for receiving externally-provided image information through a communication line.

8. A thermal transfer recording apparatus for transferring an ink of an ink sheet to a recording medium to thereby effect recording of images on said recording medium, comprising:

ink sheet conveying means for conveying said ink sheet;

recording medium conveying means for conveying said recording medium, said recording medium conveying means having a driving torque;

recording means for acting on said ink sheet to thereby effect recording of images on said recording medium when said recording medium and said ink sheet are held together, said driving torque causing said recording medium and said ink sheet to be separated;

counting means for counting a quantity of driving information of image data recorded by said recording means; and control means for controlling so as to change the driving torque of said recording medium conveying means in conformity with the quantity of said driving information counted by said counting means.

9. A thermal transfer recording apparatus according to claim 8, wherein said ink sheet is a multiprint ink sheet having an amount of the ink enabling plural times of transfer from a same portion.

10. A thermal transfer recording apparatus according to claim 8, wherein said control means increased a driving current value of said recording medium conveying means to thereby increase the driving torque of said recording medium conveying means when the quantity of dot driving information is great.

11. A thermal transfer recording apparatus according to claim 8, wherein said control means decreased a driving current value of said recording medium conveying means to thereby decrease the driving torque of said recording medium conveying means when the quantity of dot driving information is small.

12. A thermal transfer recording apparatus according to claim 8, wherein said recording means further comprises a thermal head provided with a plurality of heat generating elements, and said dot driving information is information for causing said heat generating elements to generate heat.

13. A thermal transfer recording apparatus according to claim 8, wherein the quantity of said driving information is counted before said recording means is driven.

14. A thermal transfer recording apparatus according to claim 8, wherein said ink sheet is a multiprint ink sheet having an amount of the ink enabling plural times of transfer from a same portion.

15. A thermal transfer recording apparatus according to claim 8, wherein the heat transfer recording apparatus is a facsimile apparatus having receiving means for receiving externally-provided image information through a communication line.

16. A thermal transfer recording method of transferring an ink of an ink sheet to a recording medium to record images on said recording medium, comprising the steps of:

providing recording medium conveying means for conveying said recording medium, said recording medium conveying means having a driving torque;

acting on said ink sheet using a recording means for recording to record images on said recording medium while holding said recording medium and said ink sheet together;

conveying said recording medium and said ink sheet;

determining a quantity of a dot driving information;

separating said recording medium and said ink sheet by applying said driving torque; and controlling said driving torque is conformity with said quantity of said dot driving information.

17. A thermal transfer recording method according to claim 16, wherein said ink sheet is a multiprint ink sheet having an amount of the ink enabling plural times of transfer from a same portion.

18. A thermal transfer according method according to claim 16, wherein said step of controlling further comprises increasing a driving current value of said recording medium conveying means to thereby increase the driving torque of said recording medium conveying means when the quantity of dot driving information is great.

19. A thermal transfer recording method according to claim 16, wherein said step of controlling further comprises decreasing a driving current value of said recording medium conveying means to thereby decrease the driving torque of said recording medium conveying means when the quantity of dot driving information is small.

20. A heat transfer recording method according to claim 16, wherein said recording means further comprises a thermal head provided with a plurality of heat generating elements, and said dot driving information is information for causing said heat generating elements to generate heat.

21. A thermal transfer recording apparatus according to claim 16, wherein the quantity of said dot driving information is counted before said recording means is driven.

22. A thermal transfer recording method according to claim 16, wherein said ink sheet is a multiprint ink sheet having an amount of the ink enabling plural times of transfer from a same portion.

23. A thermal transfer recording method according to claim 16, wherein the heat transfer recording method is employed in a facsimile apparatus having receiving means for receiving externally-provided image information through a communication line.

24. A thermal transfer recording apparatus comprising:

a fixed full line type thermal recording head, said head selectively recording images on a recording medium;

counting means for counting a quantity of an information to be recorded; and first moving means for moving an ink sheet past said thermal recording head in a first direction; and second moving means for moving a recording medium past said thermal recording head in a second direction, said first and said second direction being opposite to one another;

said first and second moving means each having a corresponding moving torque wherein at least one of said first and second moving means change said corresponding moving torque in accordance with said quantity of said information to be recorded, said corresponding moving torque being increased as said quantity of said information to be recorded is increased.

25. A thermal transfer recording apparatus according to claim 24, further comprising control means for controlling said moving torque of said second moving means, said control means increasing a driving current value of said second moving means to thereby increases the moving torque of said second moving means when the quantity of information is great.

26. A thermal transfer recording apparatus according to claim 24, further comprising control means for controlling said moving torque of said second moving means, said control means decreasing a driving current value of said second moving means to thereby decrease the moving torque of said second moving means when the quantity of information is small.

27. A thermal transfer recording apparatus according to claim 24, wherein said recording head further comprises a plurality of heat generating elements, and said information is information for causing said heat generating elements to generate heat.

28. A thermal transfer recording apparatus according to claim 24, wherein the quantity of said information is counted before said recording means is driven.

29. A thermal transfer recording apparatus according to claim 24, wherein said ink sheet is a multiprint ink sheet having an amount of the ink enabling plural times of transfer from a same portion.

30. A thermal transfer recording apparatus according to claim 24, wherein said thermal transfer recording apparatus is a facsimile apparatus having receiving means for receiving externally-provided image information through a communication line.

* * * * *

UNITED STATES PATENT AND TRADEMARK OFFICE

CERTIFICATE OF CORRECTION

PATENT NO. : 5,206,661

DATED : April 27, 1993

INVENTOR(S) : HISAO TERAJIMA ET AL.

It is certified that error appears in the above-identified patent and that said Letters Patent is hereby corrected as shown below:

On the Title page, item [54] TITLE

"CONVEYS" should read --CONVEYS THE RECORDING MEDIUM--.

item [56] REFERENCES CITED

Foreign Patent Documents,
"6258917" should read --62-58917--.

item [30] FOREIGN APPLICATION PRIORITY DATA

Insert, --[30] Foreign Application Priority Data
November 4, 1988 [JP] Japan..... 63-277487--.

COLUMN 1

Line 3, "CONVEYS" should read
--CONVEYS THE RECORDING MEDIUM--.
Line 7, "heat" should read --thermal--.
Line 11, "heat" should read --thermal--.
Line 19, "correspondance" should read --correspondence--.
Line 23, "signal" should read --single--.
Line 32, "heat" should read --thermal--.

COLUMN 2

Line 66, "which" should be deleted.

UNITED STATES PATENT AND TRADEMARK OFFICE

CERTIFICATE OF CORRECTION

PATENT NO. : 5,206,661

DATED : April 27, 1993

INVENTOR(S) : HISAO TERAJIMA ET AL.

It is certified that error appears in the above-identified patent and that said Letters Patent is hereby corrected as shown below:

COLUMN 3

Line 61, "transmission" should read --transmission,--.
Line 62, "the" should be deleted.
Line 63, "an" should be deleted.

COLUMN 4

Line 5, "the" should be deleted.
Line 6, "the" should be deleted.
Line 12, "the" should be deleted.
Line 18, "The reference" should read --Reference--.
Line 33, "the" (second occurrence) should be deleted.
Line 44, "the" (second occurrence) should be deleted.
Line 66, "which" should read --while--.
Line 67, "they" should read --thus--.

COLUMN 5

Line 5, "the" should be deleted.
Line 7, "the" should be deleted.
Line 11, "the" should be deleted.
Line 18, "The reference" should read --Reference--.
Line 21, "the" should be deleted.
Line 35, "sheet 14" should read --sheet 14 and--.
Line 37, "fluctuation" should read --fluctuations--.
Line 54, "The reference" should read --Reference--.

UNITED STATES PATENT AND TRADEMARK OFFICE

CERTIFICATE OF CORRECTION

PATENT NO. : 5,206,661

DATED : April 27, 1993

INVENTOR(S) : HISAO TERAJIMA ET AL.

It is certified that error appears in the above-identified patent and that said Letters Patent is hereby corrected as shown below:

COLUMN 6

Line 31, "The reference" should read --Reference--.
Line 36, "The refer-" should read --Refer- --.

COLUMN 7

Line 42, "the" (first occurrence) should be deleted.
Line 44, "the" should be deleted.
Line 58, "value" should read --the value--.
Line 59, "the" should be deleted.

COLUMN 8

Line 14, "the step S6," should read --step S6, the--.

COLUMN 9

Line 52, "etholocellulose" should read --ethylcellulose--.
Line 55, "limating" should read --limatable---.
Line 59, "quanamine" should read --guanamine--.

COLUMN 10

Line 5, "applicable, in" should read --applicable in,--.

UNITED STATES PATENT AND TRADEMARK OFFICE

CERTIFICATE OF CORRECTION

PATENT NO. : 5,206,661

DATED : April 27, 1993

INVENTOR(S) : HISAO TERAJIMA ET AL.

It is certified that error appears in the above-identified patent and that said Letters Patent is hereby corrected as shown below:

COLUMN 11

Line 28, "form" should read --from--.
Line 30, "heat" should read --thermal--.
Line 62, "increased" should read --increases--.
Line 68, "decreased" should read --decreases--.

COLUMN 12

Line 19, "heat" should read --thermal--.
Line 38, "is" should read --in--.
Line 44, "according method" should read --recording method--.
Line 59, "heat" should read --thermal--.
Line 65, "apparatus" should read --method--.

COLUMN 13

Line 6, "heat" should read --thermal--.
Line 22, "direction" (second occurrence) should read --directions--.

UNITED STATES PATENT AND TRADEMARK OFFICE

CERTIFICATE OF CORRECTION

PATENT NO. : 5,206,661

DATED : April 27, 1993

INVENTOR(S) : HISAO TERAJIMA ET AL.

It is certified that error appears in the above-identified patent and that said Letters Patent is hereby corrected as shown below:

COLUMN 14

Line 5, "increases" should read --increase--.

Signed and Sealed this

Thirtieth Day of November, 1993

Bruce Lehman

*Attest:*

BRUCE LEHMAN

*Attesting Officer*

*Commissioner of Patents and Trademarks*